US005569492A

United States Patent [19]

Devine et al.

[11] Patent Number: 5,569,492

[45] Date of Patent: Oct. 29, 1996

[54] STRIPE INTERNAL EDGING METHOD AND APPARATUS

[75] Inventors: William D. Devine; Kenneth J. Ruschak, both of Rochester, N.Y.

[73] Assignee: Eastman Kodak Company, Rochester, N.Y.

[21] Appl. No.: 339,307

[22] Filed: Nov. 14, 1994

Related U.S. Application Data

[63] Continuation of Ser. No. 138,305, Oct. 18, 1993, abandoned.

[51] Int. Cl.[6] ..... B05D 1/30; B05C 5/00

[52] U.S. Cl. ..... 427/286; 427/294; 427/420; 118/324; 118/326; 118/DIG. 4

[58] Field of Search ..... 427/420, 294, 427/286; 118/DIG. 4, 324, 326

[56] References Cited

U.S. PATENT DOCUMENTS

| | | | |
|---|---|---|---|
| 3,508,947 | 4/1970 | Hughes | 117/34 |
| 3,867,901 | 2/1975 | Greiller | 118/50 |
| 4,019,906 | 4/1977 | Ridley | 96/68 |
| 4,233,346 | 11/1980 | Kerkhofs | 427/345 |
| 4,297,396 | 10/1981 | Takehara et al. | 427/284 |
| 4,479,987 | 10/1984 | Koepke et al. | 427/402 |
| 4,830,887 | 5/1989 | Reiter | 427/420 |
| 4,977,852 | 12/1990 | Ishizuka | 118/411 |
| 5,382,292 | 1/1995 | Conroy et al. | 118/324 |

FOREIGN PATENT DOCUMENTS

| | | | |
|---|---|---|---|
| 160609 | 11/1983 | Germany | 427/420 |
| 90/11179 | 2/1990 | WIPO | 427/420 |

OTHER PUBLICATIONS

M.G. Antoniades, "A New Method of Measuring Dynamic Surface Tension", Journal of Colloid and Interface Science, vol. 77, No. 2, Oct. 1980.

*Primary Examiner*—Katherine Bareford
*Attorney, Agent, or Firm*—Arthur H. Rosenstein

[57] ABSTRACT

The present invention is a method and apparatus for curtain coating a support with one or more layers of a liquid coating composition. Stripes of a liquid coating composition are formed at the edges of the free falling curtain. These stripes are guided by edge guides which are positioned so that there is an uncoated margin of support at each edge of the support. Liquid is removed from the edges of the free falling curtain near the point of impingement on the support. Drag that emanates from the edge guide is contained within the stripe which is removed thereby producing a more uniform coating. In addition free falling curtains having an extremely low flow rate can be coated that previously were not possible.

10 Claims, 9 Drawing Sheets

STRIPE INTERNAL EDGING METHOD AND APPARATUS

This is a Continuation of U.S. application Ser. No. 138,305, filed 18 Oct. 1993 now abandoned.

FIELD OF THE INVENTION

This invention pertains to a method and apparatus for applying liquid compositions to a moving web using the method known as curtain coating.

BACKGROUND OF THE INVENTION

In the curtain coating method for applying liquid compositions to a moving web, one or more distinct layers form a free-falling curtain and impinge on a moving web thereby coating the web. The distinct layer or layers may be formed by means of either a slide or extrusion hopper as described in U.S. Pat. Nos. 3,508,947 (Hughes) and 3,867,901 (Greiller). In order to prevent contraction of the falling curtain, it is necessary to provide edge guides at the longitudinal edges of the curtain to maintain the width of the curtain along its length. The edge guides can be positioned outside the width of the web to be coated so the entire width of the web is coated, or the edge guides can be located inboard of the edges of the web so as to leave an area of uncoated web at each longitudinal edge. This is known as the "internal" curtain coating edging process. The current state of the art of the internal edging process shown in FIG. 1, is described in U.S. Pat. No. 4,830,887 to Reiter assigned to Eastman Kodak Company.

In U.S. Pat. No. 4,830,887, a slide coating hopper 10 has two bent slotted tubes 50 as the edge guides. The tubes 50 are positioned so that the coating width is less than the width of the web or support 18. The free-falling composite curtain 12 extends transversely of the path of the moving support 18, drops over a height "h", and impinges onto the moving support 18 to form a multilayer coating. Support 18 is guided around a coating roller 8 where the curtain 12 impinges onto the support. A low viscosity flushing liquid 21, preferably water, is delivered at the top of the slotted edge guide 50 and distributed over the entire height of the edge guide from the coating edge 15 to the point where the slotted edge guides bend upwardly, just above the point where the curtain 12 impinges on the support 18. FIG. 2 is a cross-sectional view of the free-falling curtain 12, showing the slotted edge guide 50 with the flushing liquid 21. The width of the flushing solution 21 adjacent the free falling curtain is typically about 1–2 mm. At the bottom of the edge guide 50 a vacuum 53 removes substantially all of the flushing liquid 21 and even a small amount of the free falling curtain 12 before the curtain impinges on the moving web or support 18 as shown in FIG. 3.

Since the edge guides described above are stationary, the falling curtain will experience drag in the areas adjacent to the edge guides. The fluid velocity in the areas adjacent to the edge guides will be substantially reduced relative to the center portion of the curtain that is essentially in free fall. If the width of the flushing solution adjacent to the edge guides is too narrow, the area of reduced velocity will necessarily extend into the edge portions of the main body of the free-falling curtain that typically includes various photographic compositions. Further reductions in the velocity of the edge portions of the curtain can be caused by the suction system at the bottom of the edge guide. Any reduced velocity in the edge portions of the curtain causes these portions to impinge onto the moving web with less momentum relative to the center portion of the curtain. This causes the edge portions to be prone to air entrainment or otherwise coat in an unsteady, ragged, or wavy manner. In extreme cases, the reduction in velocity in the edge portions of the curtain can cause the curtain itself to be unstable at the bottom of the edge guides and may even break spontaneously from the edge guides. These problems limit the coating speed and minimum coating thickness and are exacerbated when the viscosities of the liquid compositions are high.

The patent of Ridley (U.S. Pat. No. 4,019,906) is an attempt to provide means to have a curtain that is stable at the edge guides when the central portion of the curtain has a low flow rate. Two edge curtains are formed using two additional coating hoppers 2, 3 as shown in FIG. 4. The curtain is stabilized along the edge guides 4 by maintaining a high flow rate per unit width in each of the edge curtains 9, 10, allowing the flow rate in the central portion of the curtain to remain low. This method has several serious disadvantages. First, it would be very difficult or even impossible to retrofit an existing curtain coating hopper with the additional coating hoppers 2, 3. Thus, it would be necessary to fabricate new hoppers to practice the method. The fabrication of new hoppers is an extremely expensive and time-consuming process. In addition, the method is not capable of performing internal edging. Moreover, the surface tension, viscosities and flow rates of the stripe must all be selected to preserve the stripe width on the hopper slide. Furthermore, no means are provided to apply a flushing solution to the edge guides. Thus, contamination problems can be expected when the edge curtains contain solutions that congeal or solidify such as aqueous gelatin solutions. The edge curtains may also break away from the guide, particularly if the viscosity of the auxiliary curtain is high. Finally, the edge curtains are rather wide (>5% of the main body that contains the photographic compositions). This limits the yield of photographic product that can be produced on a given coating machine and results in increased costs due to the waste associated with the edge curtain composition.

The present invention solves the problems of the prior art outlined above and allows for curtain coating of very low flow rates per unit width that was not possible with the prior art method and apparatus. The method allows more latitude for choice of stripe flow rate and viscosity which can be of benefit in increasing speeds or in achieving lower flow rate curtains.

SUMMARY OF THE INVENTION

The present invention includes a method of curtain coating a support with one or more layers of a liquid coating composition comprising:

- moving the support along a path through a coating zone;
- forming one or more flowing layers of coating liquids to form a composite layer;
- forming a free-falling curtain having a pair of edges from said composite layer within said coating zone which extends transversely of said path and impinges on said moving support;
- forming stripes of liquid coating composition contiguous with each edge of said free-falling curtain;
- laterally guiding said stripes by edge guides arranged to coat less than the width of said support;

maintaining said stripes in wetting contact with said edge guides by distributing flushing liquid from said edge guides contiguous with said stripes; and extracting liquids from the edge of said falling curtain by a vacuum source connected to the point of impingement of said falling curtain.

The present invention also includes an apparatus for curtain coating a support by depositing one or more coating liquids onto a moving support comprising:

conveying means including a coating roll for moving said support along a path through a coating zone;

hopper means for forming a composite layer of one or more flowing layers of coating liquid to form a free-falling curtain having a pair of edges;

stripe solution means for forming stripes of liquid coating composition contiguous with each edge of said curtain which extends transversely of said path and impinges on said support;

edge guide means spaced to produce a coating less than the width of said support and for laterally guiding said stripes;

flushing means for issuing liquid from said edge guide to maintain wetting contact with said stripes; and liquid removal means for extracting liquid from the edge region of said falling curtain connected to said edge guides near the point of impingement of said falling curtain.

For a better understanding of the present invention, together with other advantages and capabilities thereof, reference is made to the following disclosure and claims in connection with the above-described drawings.

DETAILED DESCRIPTION OF THE INVENTION

Figure 5:
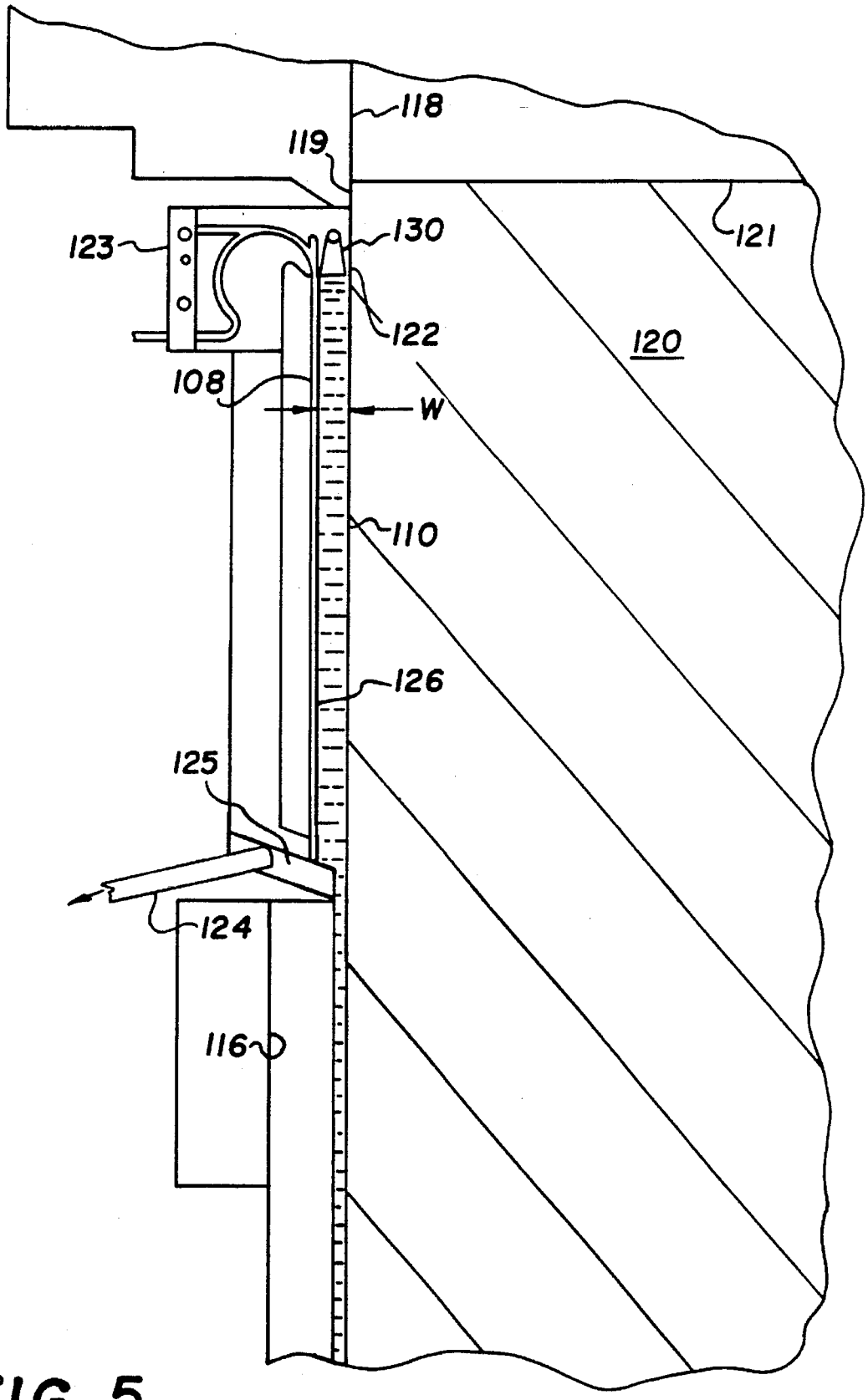
FIG. 5 is a front view of a curtain coating apparatus according to the process of the present invention.

FIG. 5 is a drawing of a front view of a curtain coater depicting an apparatus for introducing a stripe layer 110 between the edge guide 126 and the main body of the curtain 120. After flowing down the hopper slide, one or more coating compositions form a free falling curtain 120 after flowing off a vertically inclined hopper lip 121. These coating compositions constitute the photographic layers of the product being manufactured. As the photographic layers leave the hopper lip 121 and form a free falling curtain 120, the longitudinal edges are anchored first by an extension 119 of the hopper edge pad 118 that protrudes slightly past the hopper lip 121. After flowing past the hopper pad extension 119, the curtain is anchored on a portion of surface 122 of the flushing fluid delivery means 123. It is advantageous to minimize the distance that the main body of the curtain is anchored on the surface 122 of the flushing fluid delivery means 123. Typically, this distance may be between 6–12mm. After flowing past the corner of the surface 122 of the fluid flushing delivery means 123, the main body of the curtain merges with the stripe 110. The surface 122 of the flushing fluid delivery means 123 that anchors the main body of the curtain can be contoured to improve the merger between the stripe 110 and the main body of the curtain 120. As shown in FIG. 5, the stripe is formed from flow out of a radially diverging slot 130 that discharges vertically downward and that is part of the flushing fluid delivery means 123. The depth of the diverging slot 130 in the direction of the thickness of the curtain (perpendicular to page) is in the range of 0.2–2 mm. By including the stripe forming apparatus into the curtain edging hardware, it is possible to utilize the current invention on any existing curtain coating hopper. The stripe 110 extends between the main body of the curtain 120 and the thin lubricating layer 108 of water or other low viscosity liquid that flows along the edge guide 126. The lubricating layer of water is necessary to prevent contamination of the edge guide 126 and improve the stability of the stripe along the curtain edge guides.

At the bottom of the edge guide 126 a suction source 124 and blade 125 remove the lubricating layer and the desired portion of the stripe 110. The blade 125 is a short distance (0.1–2 mm) above the moving support 116. Preferably, the blade method is used to intercept and remove the desired quantity of the falling liquids. This blade removal apparatus is described in more detail in USSN Ser. No. 08/001,485, now abandoned filed Jan. 7, 1993. In all cases, it is desirable to remove all the lubricating layer 108 of water before it impinges upon the moving support 116 since it will generally not coat uniformly and can cause the coated edges of the support to dry improperly. In an especially preferred embodiment, the amount of the stripe that is intercepted by the blade is adjustable. For high speed coating, only a portion of the stripe is intercepted and removed to obtain a coated stripe edge that is of excellent quality and not prone to air entrainment, raggedness, or waviness. The successful coating of the edge portions is achieved by judiciously adjusting the flow rate and viscosity of the stripe composition. Because the stripe discharges into the curtain rather than the hopper slide, there is great latitude in changing viscosity and flow rate of the stripe without affecting its width. This allows the coating speed to be maximized according to the air entrainment speed for the main body of the curtain and the capacity of the dryers. The coating thickness of the stripe is kept below that of the main curtain so that the drying of the stripe does not limit coating speed. In the prior art of internal edging, the coating speed was limited by the coating of the edge portions of the main curtain for which there is little or no latitude in adjusting the viscosity and flow rate.

For thin coatings at low coating speeds, the stripe has a viscosity and flow rate that ensures stability at the edge guide. Usually this will mean a lower viscosity and a higher flow rate per unit width than the main body of the curtain. By adjusting the blade to intercept and remove all of the edge stripe before it impinges on the moving support, it is possible to achieve a curtain that is stable at the edge guides without having to coat and dry the stripes. It has been found, surprisingly, that very thin curtains with flow rates as low as 0.75 cc/cm/s and perhaps even lower can be coated successfully using this method. Currently, curtains with flow rates below 1.5 cc/cm/s are not considered practical using the prior art of internal edging technology.

The stripe composition generally is an aqueous gelatin solution with appropriate surfactants added to balance the surface tension of the stripe with the top and bottom layers of the curtain. It is envisioned that thickeners could also be added to the stripe composition. Since the stripe composition is not part of the main body of the curtain that contains the product layers, there is a great degree of freedom available in selecting the viscosity and flow rate and composition of the stripe so as to optimize the coating and drying quality of the final product and insure that the curtain is stable at the edge guides. It has been found that the stripe viscosity is optimally in the range of 1–30 cP and preferably in the range of 5–20 cP. The flow rate of the stripe should be chosen to be greater than the minimum possible to achieve a stable curtain along the edge guides. This flow rate can be estimated from the following inequality, *Journal of Colloid and Interface Science*, Vol. 77, No. 2, October 1980, pp. 583–585:

$$Q \geqq 2T/\rho U$$

where

Q=stripe volumetric flow rate per unit width

T=local surface tension

ρ=stripe density

U=local stripe curtain speed

Using this inequality, it is possible to calculate the minimum stripe flow rate required to give an unconditionally stable stripe curtain at a given elevation having local values of stripe curtain speed and surface tension. A stripe curtain that is unconditionally stable at one elevation will be unconditionally stable at all points below, and the stripe curtain will spontaneously heal if perforated. The portion of the curtain intercepted by the start/finish pan must be unconditionally stable. Achieving this also guarantees that the curtain is unconditionally stable at the bottom of the edge guide, so the curtain will not walk up the edge guide or break away completely from the edge guide.

The width of the stripe, W (see FIG. 5), in the horizontal direction (or direction perpendicular to the edge guide in the plane of the curtain) is chosen so as to completely isolate the main body of the curtain from the drag that emanates from the edge guide. Thus, any reductions in velocity due to drag occur within the stripe as opposed to the main body of the curtain as is the case in the prior art. The reduction in velocity of the stripe due to the drag along the edge guides does not affect the maximum coating speed or the minimum flow rate of the main body of the curtain since the viscosity and flow rate of the stripe have been judiciously chosen so as to give a stable curtain along the edge guides and resist air entrainment or an otherwise unstable coating of the stripe composition if it is desired to coat the stripe composition. It has been found that when the width of the stripe is at least 3–10 mm, depending on the type of the curtain edge guide used, the main body of the curtain is not affected by the drag along the edge guide since the drag is contained within the width of the stripe. The width of the stripe as it falls depends on surface tension differences between the stripe and main curtain. Through choice of surfactants and their concentrations, the width of the stripe can be maintained substantially constant as the curtain falls.

Figure 6:
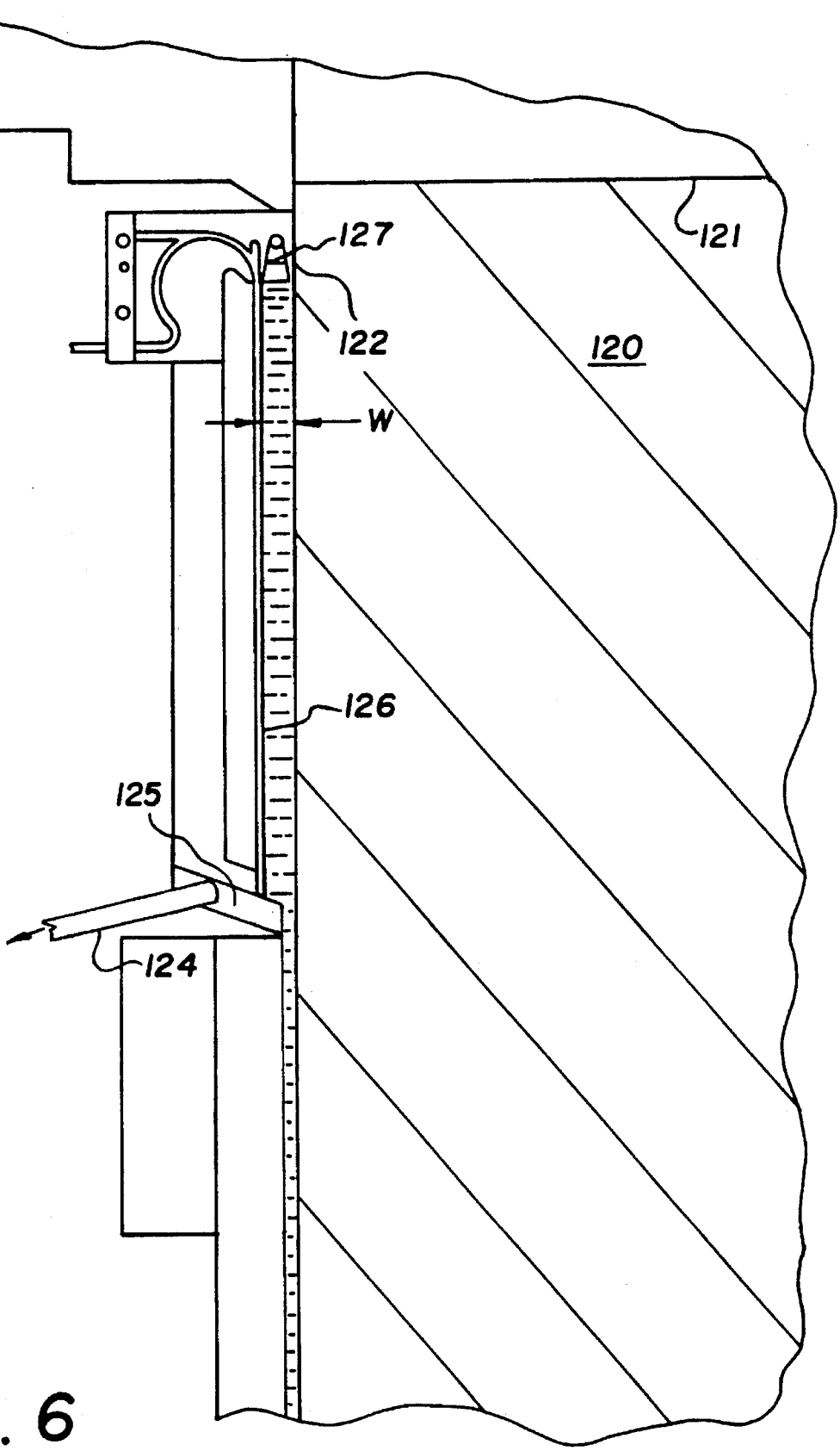
FIG. 6 is a front view of a curtain coating apparatus according to an embodiment of the present invention.
Figure 7:
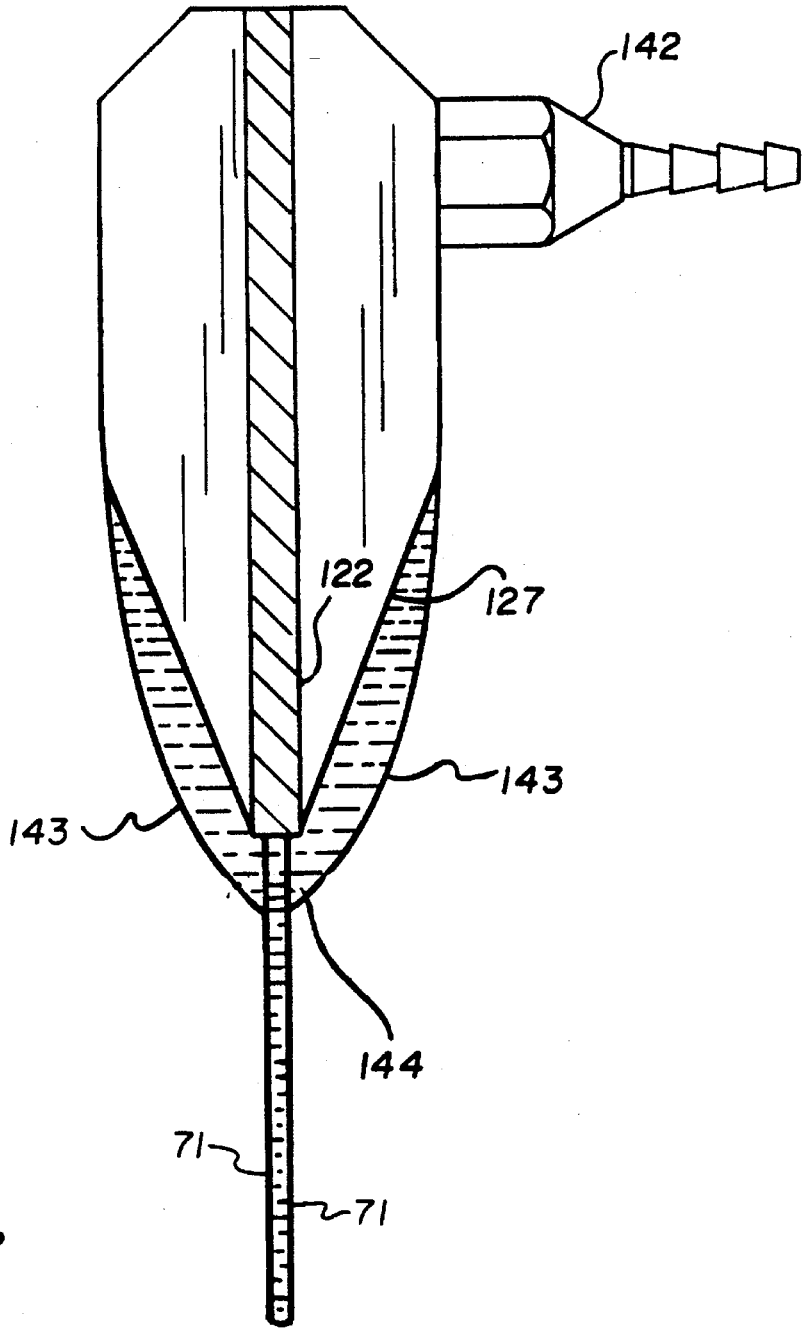
FIG. 7 is a view along the plane of the curtain of an apparatus to introduce a stripe composition into a falling curtain in accordance with another embodiment of the present invention.

FIG. 6 depicts a preferred embodiment of the present invention which makes it easier to maintain stripe width. FIG. 6 shows essentially the same apparatus as in FIG. 5 except that air-liquid interfaces are formed on the front and back stripe surfaces on the vertically inclined diverging slot 127 before merging with the main body of the curtain 120. This allows the free surfaces of the stripe to age before merging with the curtain. It has been found that when a stripe-air interface of at least 6 mm is formed before the stripe merges with the main body of the curtain that an improved interface is formed between the stripe and the main body of the curtain. This is thought to be because surfactant has time to diffuse to the air interface and lower surface tension before the stripe merges with the main curtain. FIG. 7 depicts a side view of the diverging slot 127 with means for creating two air-liquid interfaces. FIG. 7 shows the surface 122 which initially anchors the edge of the main curtain. The stripe inlet 142 provides the fluid to the diverging slot 127. The fluid forms a free surface 143 with the atmosphere on each side of the curtain prior to merging at point 144 to form the stripe. FIG. 7 shows the dual wires 71 of the edge guide. This edge guide is described in USSN Ser. No. 07/979,504, now U.S. Pat. No. 5,328,726 .

Figure 8:
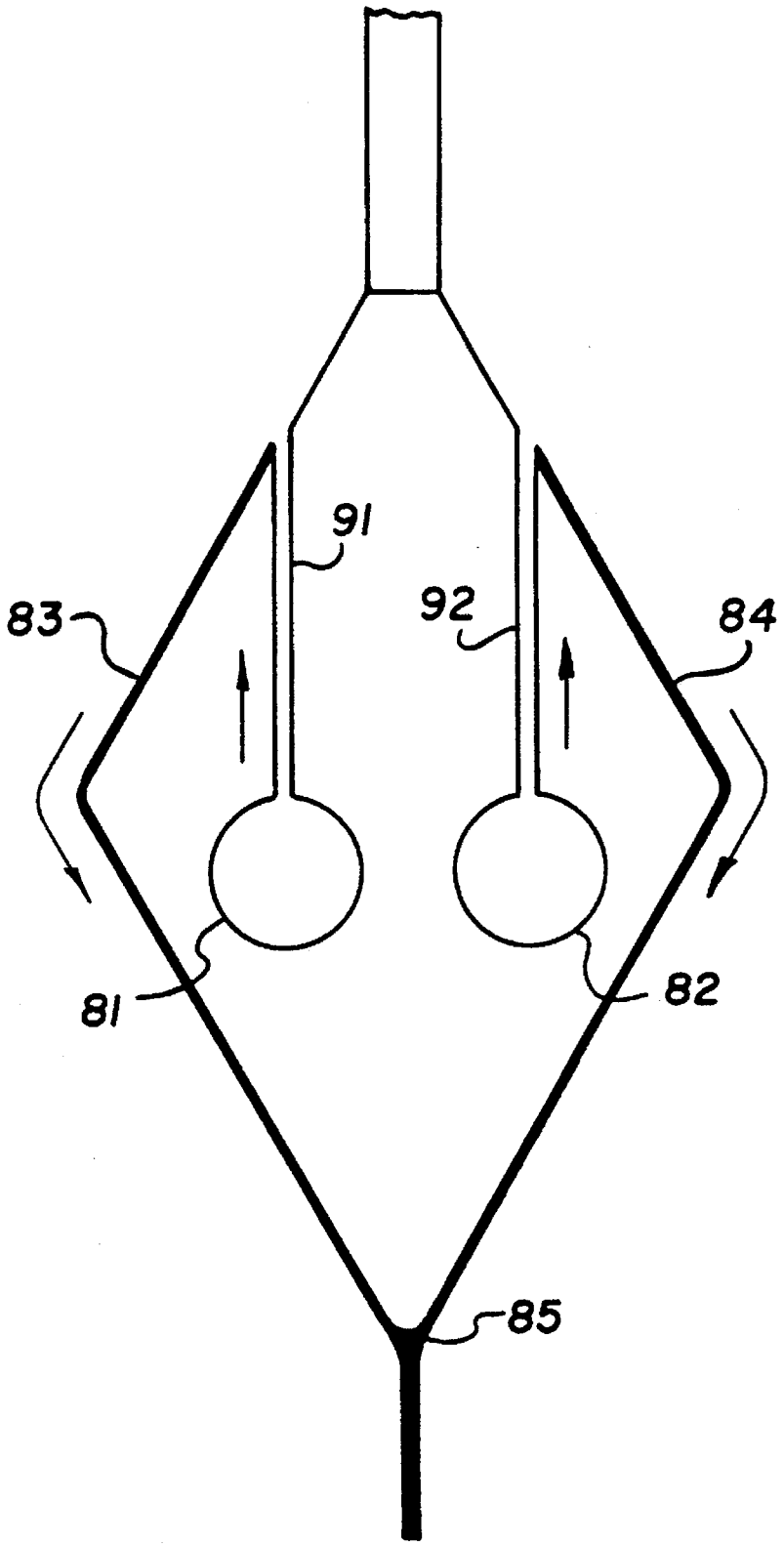
FIG. 8 is a sectional view of an apparatus to introduce a stripe composition into a falling curtain in accordance with another preferred embodiment of the present invention.

The means for forming a stripe in the curtain that is attached to the edge guide is not limited to the diverging slot method. FIG. 8 depicts another embodiment of the present invention in which the stripe is formed by means of a cavity and slot arrangement in which the stripe flows down inclined surfaces before merging with the main body of the curtain.

In this arrangement the liquid stripe material is supplied to cavities 81 and 82. The stripe material flows through slots 91 and 92 and emerges onto slides 83 and 84. In FIG. 8, the surface 122 which initially anchors the edge of the main curtain before merging with the strip is not shown. These slides merge at 85 where the main body of the curtain 120 meets the stripe.

Figure 9:
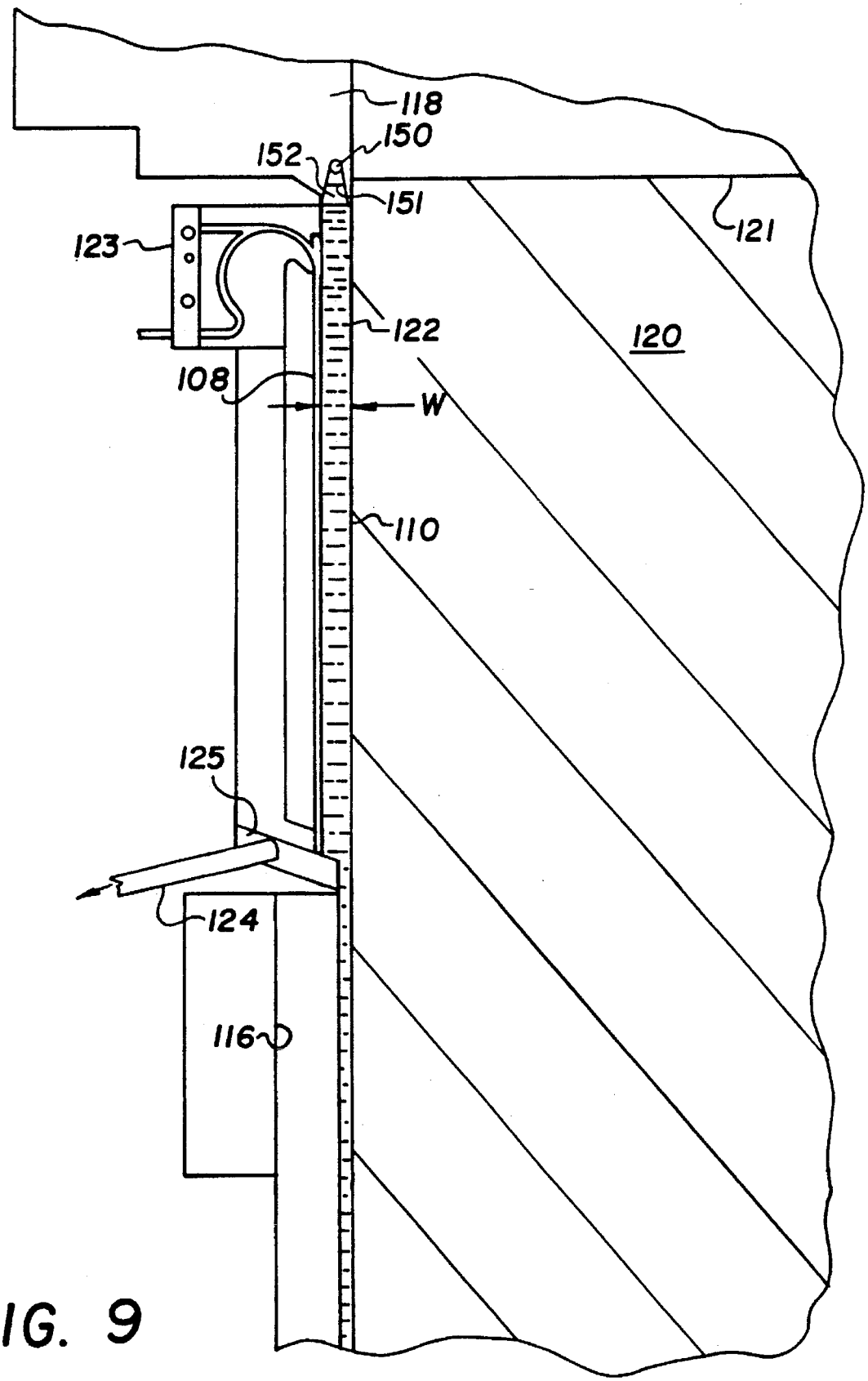
FIG. 9 is a front view of a curtain coating apparatus according to yet another embodiment of the present invention.

FIG. 9 depicts another embodiment of the present invention in which the means for forming the stripe is located on the hopper edge pad 118. The edge pad 118 is a dam which maintains the width of the layers on the hopper slide. An edge pad can be manufactured which incorporates an inlet 150 and downwardly directed metering slot 151 for forming the stripe 110. The metering slot discharges the stripe composition at or near the lip 121 of the hopper. The hopper slide itself can function as one of the two surfaces of the metering slot. This arrangement eliminates the unlubricated portion of the edge of the curtain near the hopper lip and can facilitate matching the velocities of the stripe and the main body of the curtain where they merge to improve the uniformity of the stripe and the main body in the vicinity of the interface. A preferred embodiment of this design is to flow the stripe composition from the metering slot 151 onto a diverging slide surface of the edge pad 152, at least a few millimeters in length, that terminates at or near the hopper lip 121. The slide surface 152 provides time for the stripe surfactants to diffuse to the air interface and so facilitates the matching of the surface tensions of the stripe and the main body of the curtain at the hopper lip. Matched surface tensions improve control of the stripe width and may improve the uniformity of the stripe and the main body of the curtain in the vicinity of the interface. Typically, the stripes are formed within 3 cm of the free-falling curtain.

Figure 10:
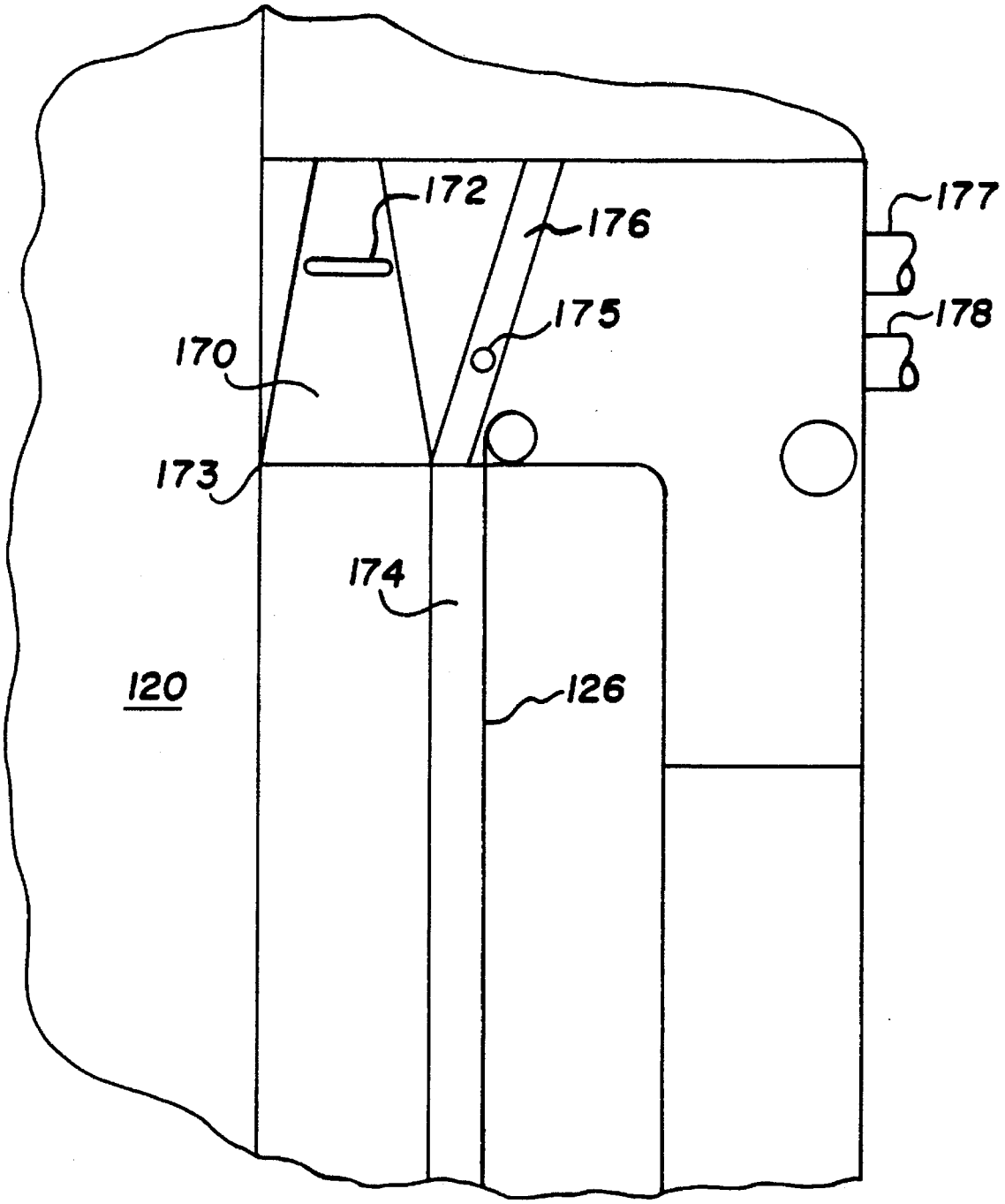
FIG. 10 is a front view of a curtain coating apparatus according to another embodiment of the invention.

FIG. 10 shows another embodiment of the present invention. The stripe fluid is introduced onto slide 170 through slot 172. A matching slide on the other side of the curtain 120 merges at 173 with slide 170. The stripe is guided down the edge guide 126 by lubricating fluid 174 introduced through outlet 175 and slide 176. On the other side of the curtain a matching slide also exists for the lubricating fluid. The stripe fluid is provided through conduit 177 and the lubricating fluid, preferably water, is provided through 178. This design described in detail in U.S. patent application Ser. No. 08/098,589 filed Jul. 28, 1993 , now U.S. Pat. No. 5,382,292 allows time for the surfactant to diffuse to the free surface thereby improving the merging between the stripe and the main body of the curtain while minimizing the distance between merger point 85 and the hopper lip.

The following Examples illustrate the advantages of the present invention over the prior art. A three-layer curtain consisting of aqueous gelatin solutions with the following properties was forming using a slide hopper:

| Layer | Viscosity (cP) | Flow Rate per Unit Width (cc/cm/s) | Fluid Density (g/cc) |
|---|---|---|---|
| Bottom | 49 | 0.29 | 1.03 |
| Middle | 45 | 1.04 | 1.03 |
| Top | 45 | 0.22 | 1.03 |

Ionic surfactants were added to the top and bottom layers according to standard practices. The curtain impinged on the moving support over the coating roll at an application point of 35 degrees from top dead center of the coating roll in the direction of roll rotation.

EXAMPLE 1

Figure 1:
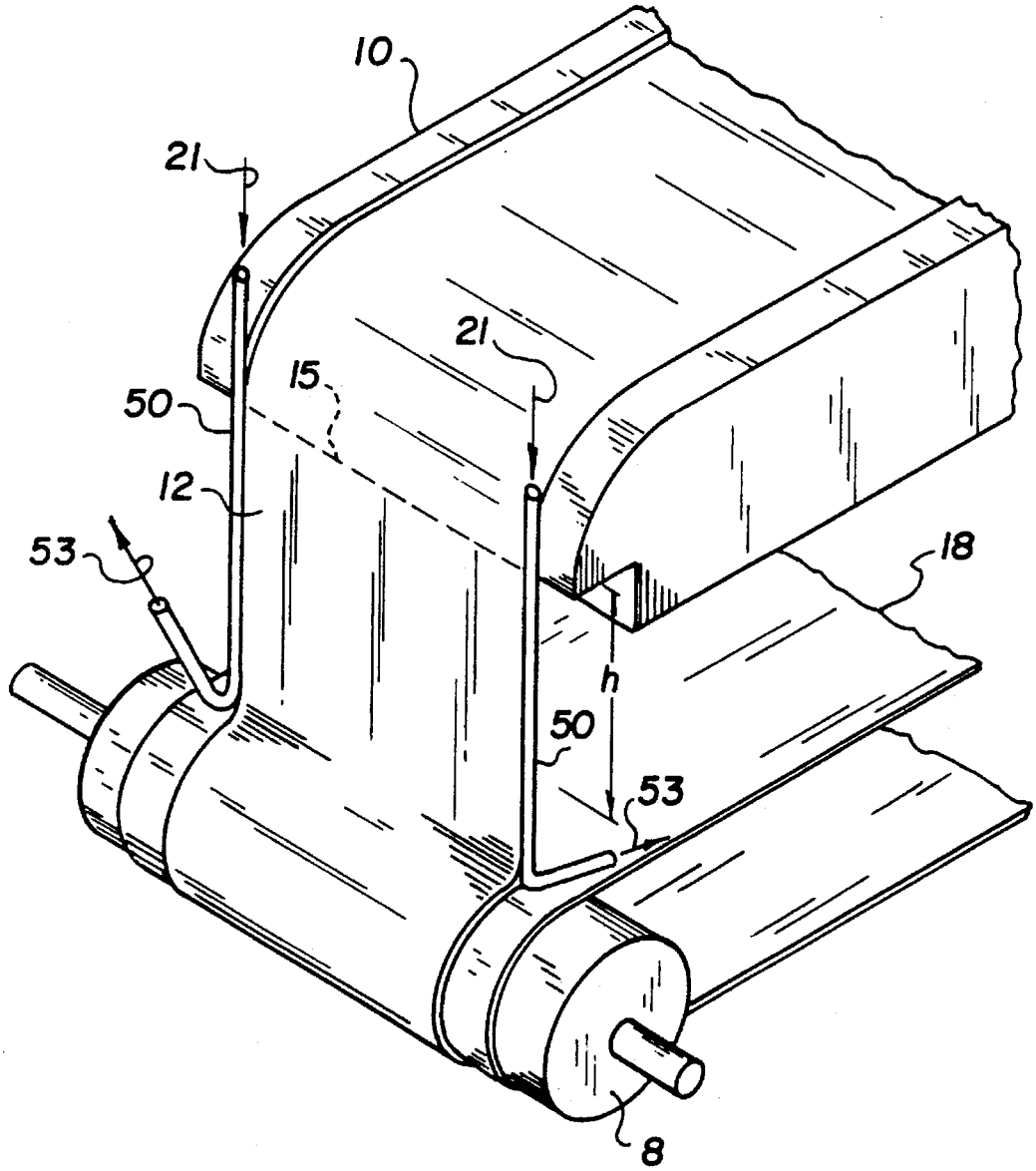
(PRIOR ART) FIG. 1
FIG. 1 is a simplified perspective view of a curtain coating apparatus of the slide hopper type in accordance with the prior art.
Figure 2:
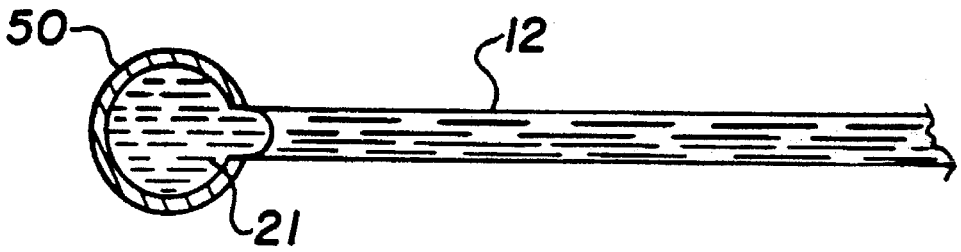
FIG. 2 (PRIOR ART)
FIG. 2 is a cross-section view of the curtain and flushing liquid using slotted edge tubes in accordance with the prior art.
Figure 3:
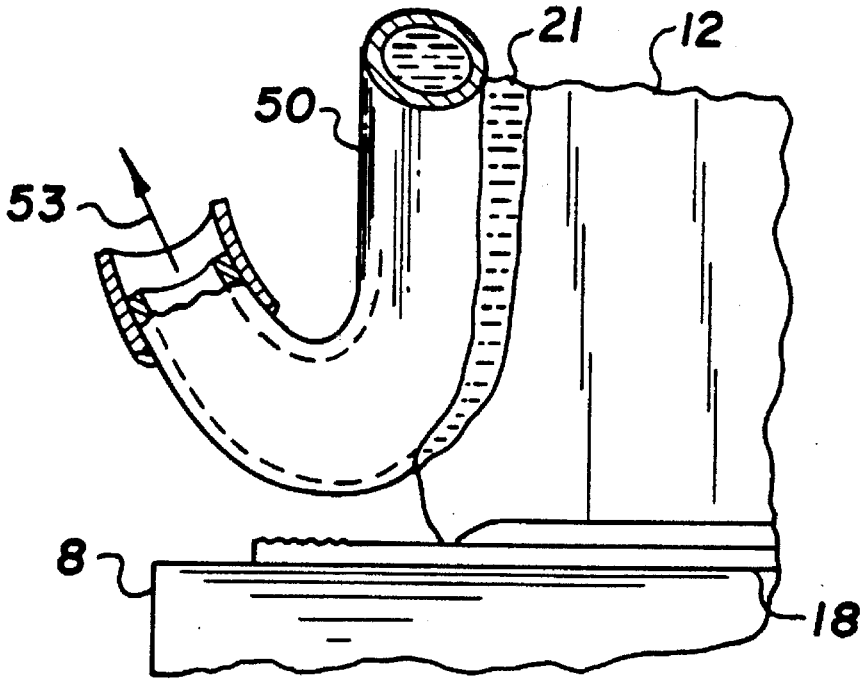
FIG. 3 (PRIOR ART)
FIG. 3 is a partial three-dimensional view, partially in cross-section showing the fluid extraction point using a slotted tube edge guide in accordance with the prior art.
Figure 4:
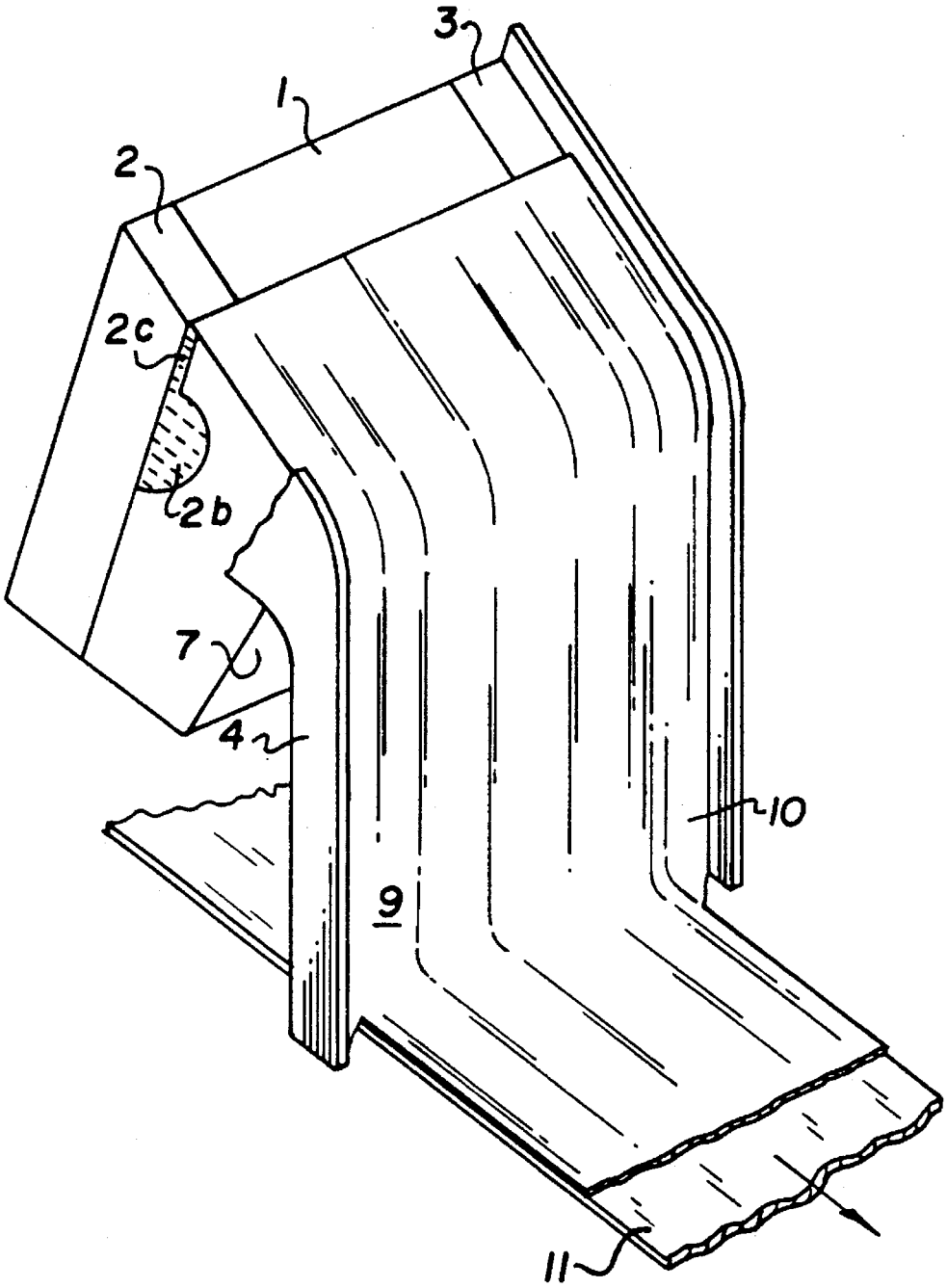
FIG. 4 (PRIOR ART)
FIG. 4 is a slide curtain coating hopper having auxiliary coating hoppers on each side in accordance with the prior art.

Slotted tube edge guides of the type shown in FIG. 1 were used to anchor the above-mentioned three-layer curtain. Lubricating water was supplied along the edge guides at a flow rate of 30 cc/min. The bottoms of the edge guides were spaced about 0.7 mm from the moving support and were placed inboard of the edges of the support. Coatings were made at speeds of 482, 533, 583, and 634 cm/s. At all four coating speeds, the edge portions of the curtain coated unacceptably in a wavy and ragged manner. At a coating speed of 583 cm/s, the edge portions were observed to be in air entrainment. At a speed of 634 cm/s, the entire width of the coating was observed to be in air entrainment.

EXAMPLE 2

Edge guides of the type shown in FIG. 5, in accordance with the present invention, were used to anchor the above-mentioned three-layer curtain. Lubricating water was supplied to the wire edge guides at a flow rate of 10 cc/min. Stripes were formed in the curtain having a width of about 6 mm. The stripes consisted of an aqueous gelatin solution with dye and ionic surfactants added to maintain stripe width reasonably constant. The flow rate of the stripes was approximately 1.6 cc/cm sec, and the stripe viscosity was 8 cP. Virtually the entire width of the stripe was allowed to impinge on the moving support, but all of the lubricating water was removed. Coatings were made at speeds of 482, 533, and 583 cm/s. At all three coating speeds, the quality of the coated edge portions containing the stripe was excellent. There was no air entrainment or wavy or ragged coating of the edge portions of the curtain. At a coating speed of 634 cm/s, the entire width of the main body of the curtain was observed to be in air entrainment.

EXAMPLE 3

The exact same apparatus and flow conditions of Example 2 were used except the lubricating water was shut off. The curtain broke at the edge guides.

EXAMPLE 4

An edge guide of the type used in FIG. 6, in accordance with a preferred embodiment of the present invention, was used to anchor to the above-mentioned three-layer curtain is described in Example 1. A stripe of the same viscosity and surfactant content as Example 2 was introduced into the curtain through a diverging slot that created an air-liquid interface for both sides of the stripe for approximately 6 mm before merging with the main body of the curtain. At stripe flow rates up to 2.5 cc/cm/s, the interface between the stripe and main body of the curtain remained essentially straight. This was not the case for the stripes formed using the apparatus of FIG. 5 where the surfaces of the stripe are not allowed to age before merging with the main body of the curtain. In that case, the interface between the stripe and the main body of the curtain departed significantly from vertical as the stripe flow rate was increased.

EXAMPLE 5

Edge guides of the type used in FIG. 6 were used to anchor the above-mentioned three-layer curtain except that the total flow rate of the three-layer curtain was reduced to 0.75 cc/cm/s from 1.55 cc/cm/s. Even at this very low flow rate, the curtain was stable at the edge guides when stripes were introduced into the curtain having a flow rate of 2.5 cc/cm/s and a viscosity of 8 cP.

The present invention has been described in detail with particular to the preferred embodiments, however, it will be apparent to those skilled in the art that various modifications and alterations may be made therein without departing from the scope of the invention as defined by the appended claims.

What is claimed is:

1. A method of curtain coating a support with one or more layers of a liquid coating composition comprising:

moving the support along a path through a coating zone;

forming one or more flowing layers of coating liquids to form a composite layer;

forming a free falling curtain having a pair of edges from said composite layer within said coating zone which extends transversely of said path and impinges on said moving support;

forming stripes of liquid coating composition having a viscosity between about 1 and 30 cP contiguous with each edge of said free falling curtain wherein the stripes are formed in the edge of said curtain and issue from a horizontal edge substantially the width of the stripes and positioned within 3 cm of the formation of the free falling curtain;

laterally guiding said stripes by edge guides arranged to coat less than a width of said support;

maintaining said stripes in wetting contact with said edge guides by distributing flushing liquid from said edge guides contiguous with said stripes wherein said stripes extend between each edge of said free falling curtain and the flushing liquid; and extracting liquids from the edge of said falling curtain by a vacuum source at the impingement of said falling curtain on said moving support.

2. The method according to claim 1 wherein said stripes are completely removed during the extraction of liquids from the edge of said falling curtain.

3. The method according to claim 1 wherein said stripes are partially removed during the extraction of liquid from the edge of said falling curtain.

4. The method according to claim 1 wherein the stripe is sufficiently wide to contain a drag layer on the main curtain that emanates from the edge guides.

5. An apparatus for laterally guiding a falling curtain to a support comprising:

at least one edge guide extending from a top of the falling curtain to the said support said at least one edge guide including:

a solid horizontal edge positioned within 3 cm of the falling curtain;

stripe formation means for supplying said edge with coating composition comprising a downwardly directed slot or slide surface inclined from horizontal for forming stripes of liquid coating composition having a viscosity between about 1 and 30 cP contiguous with an edge of the curtain, the stripes between the edge of the curtain and the edge guide wherein said solid horizontal edge is the width of the stripe;

flushing means for issuing liquid at said edge guide to maintain wetting contact with said stripe; and liquid removal means for extracting liquid from the edge region of the falling curtain positioned at the bottom of said edge guide.

6. The apparatus according to claim 5 wherein said stripe formation means comprises:

a first slide surface positioned at a top of the edge guide;

a second slide surface positioned at the top of the edge guide wherein said first and second slide terminate at a bottom of the solid land; and a metering slot for introducing fluid to said first and second slides.

7. The apparatus according to claim 5 wherein the stripe formation means comprises:

a radially diverging slot that discharges vertically downwards.

8. The apparatus according to claim 5 wherein said flushing means for issuing liquid comprises:

a first slide surface positioned at a top of the edge guide;

a second slide surface positioned at the top of the edge guide wherein said first and second slides terminate at a bottom of the solid land; and a conduit for introducing fluid to said first and second slides.

9. The apparatus according to claim 5 wherein said edge guides comprise:

a pair of wires.

10. The apparatus according to claim 5 wherein said stripes have one air interface for 6 mm or more in length before contacting the edges of the curtain.

* * * * *